US006994606B2

(12) United States Patent
Li

(10) Patent No.: US 6,994,606 B2
(45) Date of Patent: Feb. 7, 2006

(54) OVERALL ADJUSTABLE BRASSIERES

(76) Inventor: Wei Cheng Li, P.O. Box 2103, Taichung City (TW)

( * ) Notice: Subject to any disclaimer, the term of this patent is extended or adjusted under 35 U.S.C. 154(b) by 0 days.

(21) Appl. No.: 10/882,269

(22) Filed: Jul. 2, 2004

(65) Prior Publication Data

US 2006/0003669 A1 Jan. 5, 2006

(51) Int. Cl.
*A41C 3/00* (2006.01)

(52) U.S. Cl. ..... 450/82; 24/197

(58) Field of Classification Search ..... 450/17, 450/18, 23, 25, 26, 28, 63, 71, 77, 82, 79, 450/58; 2/67, 69; 24/197, 198, 200
See application file for complete search history.

(56) References Cited

U.S. PATENT DOCUMENTS 1,332,628 A * 3/1920 Leighton ..... 24/200
2,099,199 A * 11/1937 Devendor et al. ..... 24/198
2,212,862 A * 8/1940 Hirsh ..... 24/198
2,849,773 A * 9/1958 Kaselow ..... 24/200
3,040,750 A * 6/1962 Hurwitz ..... 450/58
3,222,688 A * 12/1965 Rosenzweig ..... 2/323
3,826,266 A * 7/1974 Alpert ..... 450/11
4,411,269 A * 10/1983 Weintraub ..... 450/58
6,412,150 B1 * 7/2002 Monderine ..... 24/563

* cited by examiner

*Primary Examiner*—Gloria M. Hale
(74) *Attorney, Agent, or Firm*—Rosenberg, Klein & Lee

(57) ABSTRACT

An adjustable brassiere is provided with a first adjustable buckle fastener in the middle of the interval between the two cups and second adjustable buckle fasteners in the middle of side-straps linking the two cups. Two ends of each adjustable buckle fastener are designed with two slits and a serrated cut adjacent to each inner slit. First adjustable straps extend from the two cups in the interval therebetween and are adjustable coupled to the first adjustable buckle fastener. Side-straps of the two cups include two sections from which second adjustable straps extend. The second adjustable straps are respectively adjustably coupled to the second adjustable buckle fasteners.

2 Claims, 4 Drawing Sheets

OVERALL ADJUSTABLE BRASSIERES

THE FIELD OF TECHNOLOGY

The present invention is directed to an overall adjustable brassiere comprising an adjustable design on each side of two cups to adjust the position of the cups to the most comfortable spot according to every individual's body figure.

BACKGROUND OF THE INVENTION

The brassieres are intimate clothing for women. The functions of the brassieres extend from what was simply breast protection in the past, to nowadays serving to promote breast health care and "inner beauty" enhancement. Therefore, the designs of brassieres have become more and more complicated and specialized. However, generic brassieres mostly focus on their effect on appearance, such as to present the appearance of larger breasts by application of linings or inflation, or to enable the breasts to appear to be much more outwardly projecting, or to be more revealing. These functions, without a doubt, empower a female to possess much more confidence in her appearance. Therefore, brassiere designers have put their work mostly on the pattern of the brassiere's cups.

However, brassieres are female's intimate clothing, and attention should be directed to the most essential issue of making a brassiere comfortable for a female to wear. Usually, every female's left-breast and right-breast are not the same in size and not symmetrical. Despite the fact that the distance between left and right breasts of different individuals who have the same size of breasts, are not the same, present designs of all brassieres have fixed intervals between the two cups. Referring to FIG. 6, both fixed-woven material and hook buckles fix the distance between the two cups. It is necessary to adjust the side-strap length of the two cups with the aid of buckles to lengthen or shorten chest measurement of the brassiere. When it comes to choosing brassieres, the purchasers must try brassieres on several brassieres to choose a proper brassiere, instead of only depending on cup size. Consequently, suitable fitting brassieres may not be purchasers' most favorable style, and most purchasers are reluctant to wear cups that do not properly fit.

SUMMARY OF THE INVENTION

It is therefore a primary object of the present invention to solve the above-mentioned problem and provide one kind of brassiere that is adjustable in many ways. The multiple adjustable design can fit the cups to each individual's body figure and place them in the most comfortable position. Moreover, the cups can be adjusted subject to the variations of the wearers' body figure.

According to the above object, the present invention includes a first adjustable buckle fastener in the middle of the distance between the two cups, and a second adjustable buckle fastener in the middle of each side-strap linking each cup. Each adjustable buckle fastener is a rectangle piece. Both ends of the adjustable buckle fasteners are designed with two slits. A serrated cut is arranged next to each inner slit. On both ends of the interval between the two cups are sewn with the first adjustable straps. The first adjustable straps are passed through the slits and serrated cut, thereby being fastened to the first adjustable buckle fastener. The side-straps linked to the two cups are divided into two sections. On opposite ends of the two sections are both sewn with second adjustable straps that are fastened by passing through the slits and serrated cut on the second adjustable buckle fastener. Underneath either of the first and second adjustable straps, a lining-strip is provided. The width of each lining-strip is at least equal to that of the corresponding buckle fastener.

BRIEF DESCRIPTION OF THE DRAWINGS

FIG. 5-1 is an illustration of the adjustable strap passing through the end of the adjustable buckle fastener of the present invention.

DETAILED DESCRIPTION OF THE PREFERRED EMBODIMENT

Figure 1:
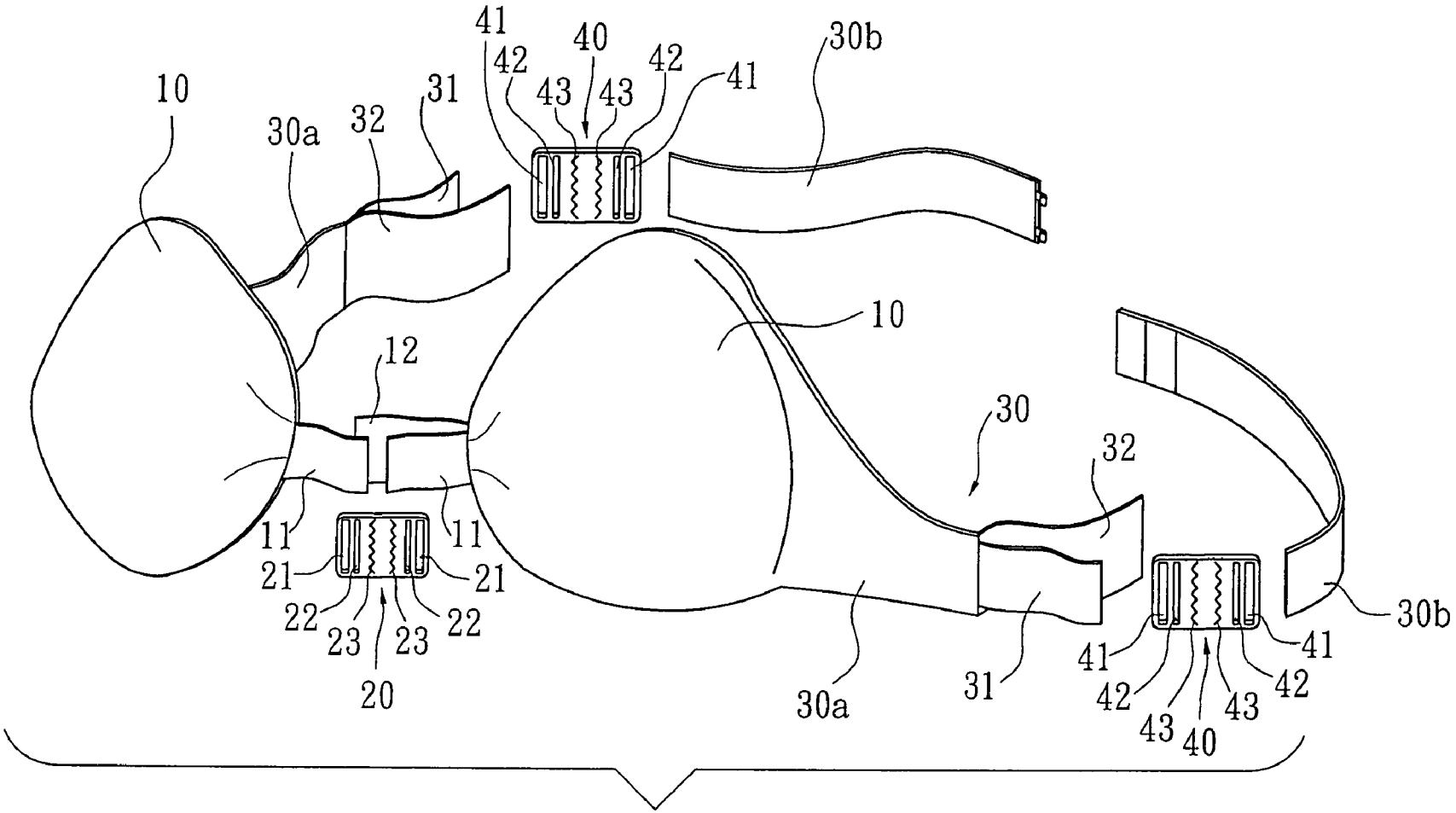
FIG. 1 is an exploded perspective view of the overall adjustable brassiere of the present invention.
Figure 2:
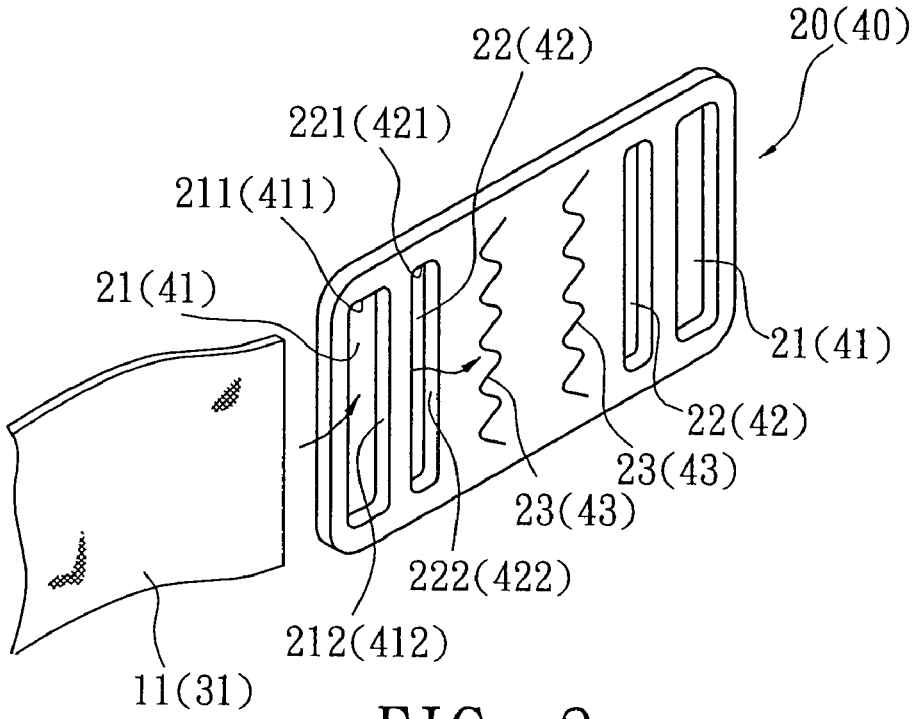
FIG. 2 is a first illustration of the adjustable strap passing through the adjustable buckle fastener of the present invention.
Figure 3:
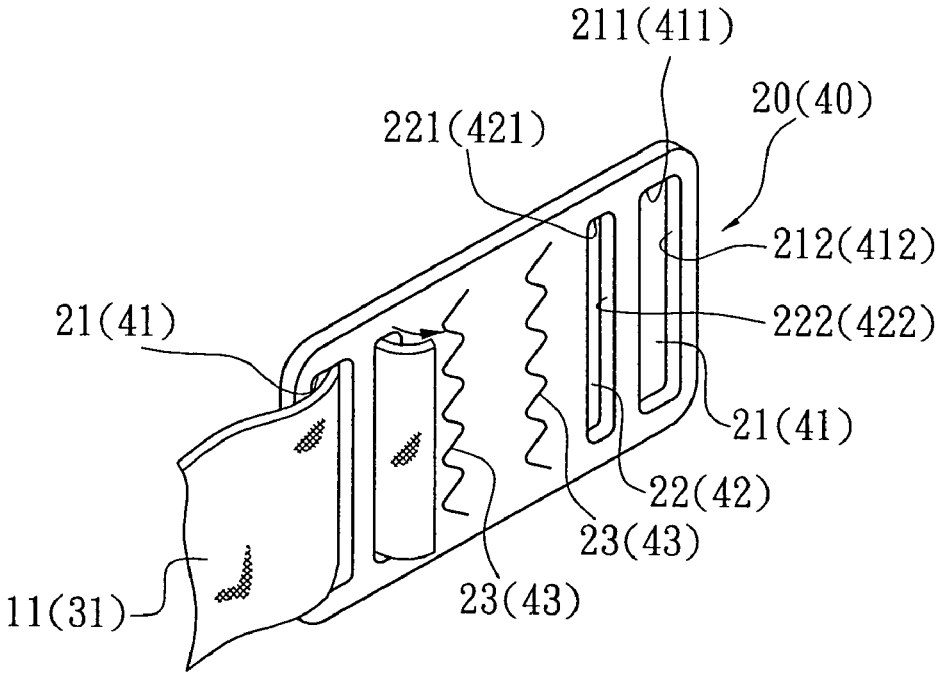
FIG. 3 is a second illustration of the adjustable strap passing through the adjustable buckle fastener of the present invention.
Figure 4:
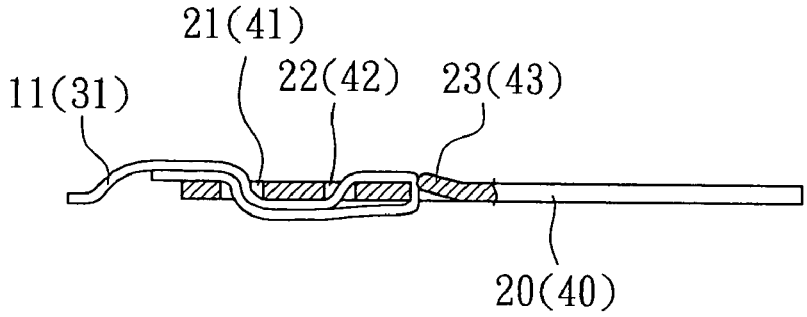
FIG. 4 is a third illustration of the adjustable strap passing through the adjustable buckle fastener of the present invention.

FIG. 1 shows the invention of an overall adjustable brassiere with the first adjustable buckle fastener (20) in the middle of the interval between two the cups (10) and the second adjustable buckle fasteners (40) in the middle of side-straps (30) linking to two cups (10, 10). Each adjustable buckle fastener (20, 40) is a rectangle piece. Two ends of each adjustable buckle fastener (20, 40) are designed with two slits (21, 22, 41, 42). There is a serrated cut formed adjacent each inner slit (23, 43). The serrated cuts on the first adjustable buckle fastener and the second adjustable buckle fastener possess a softness quality that allows the straps to be easily passed therethrough.

The first adjustable straps (11) are respectively sewn to the inside of the two cups (10) and the two slits (21, 22) on both ends of the first adjustable buckle fastener include length (211, 221) and width (212, 222). The length (211, 221) is corresponding to the width of the first adjustable straps (11), and the width (212, 222) is corresponding to the thickness of the first adjustable straps (11). Moreover, the width of either slit is not equal to that of the other. The width (212) of outer slit (21) is larger than the width (222) of inner slit (22). Therefore, referring to FIG. 2 to FIG. 5, wearers are able to adjust the interval between the two cups into each individual's optimal position by passing the first adjustable strap (11) through the outer slit (21) on the first adjustable buckle fastener 20, then through the inner slit (22), and the serrated cut (23) to fix the first adjustable strap (11).

Side-straps (30) of the two cups (10, 10) include two sections **(30*a*, 30*b*). The opposite-ends of the two sections are respectively sewn with second adjustable straps (31). Also, two slits (41, 42) on both ends of the second adjustable buckle fasteners include length (411, 421), and width (412, 422). The length is corresponding to the width of the second adjustable straps (31), and the width is corresponding to the thickness of the second adjustable straps (31). The width of either slit is not equal to that of the other. The width (412)**

of the outer slit (41) is larger than the width (422) of the inner slit (42). Therefore, referring to FIG. 2 to FIG. 5, wearers are able to adjust the length of side-straps to an optimal position subject to sizes of each individual's left-breast and right-breast, by passing the second adjustable strap (31) through the outer slit (41) on the second adjustable buckle fastener (40), then through the inner slit (42), and the serrated cut (43) to fix the second adjustable strap (31).

Figure 5:
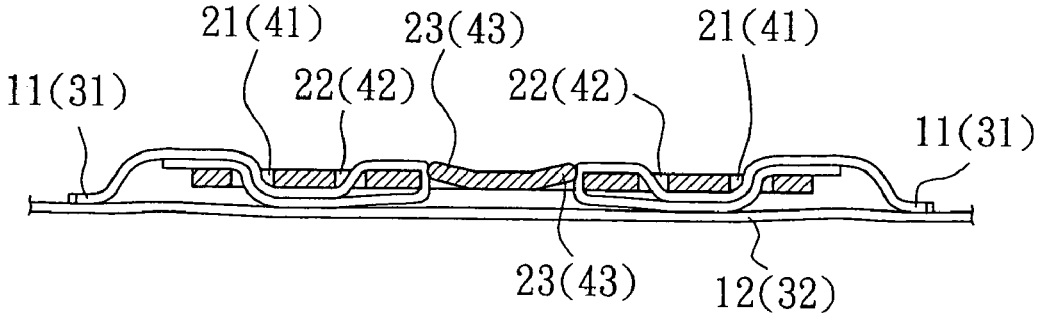
FIG. 5 is an illustration of the adjustable straps having completed passing through the adjustable buckle fastener of the present invention.
Figures 1, 5:
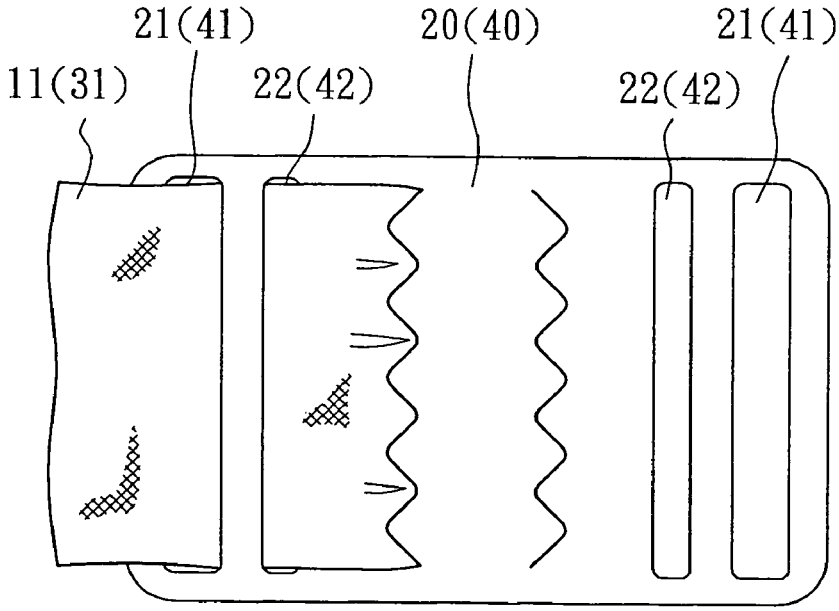
Figure 6:
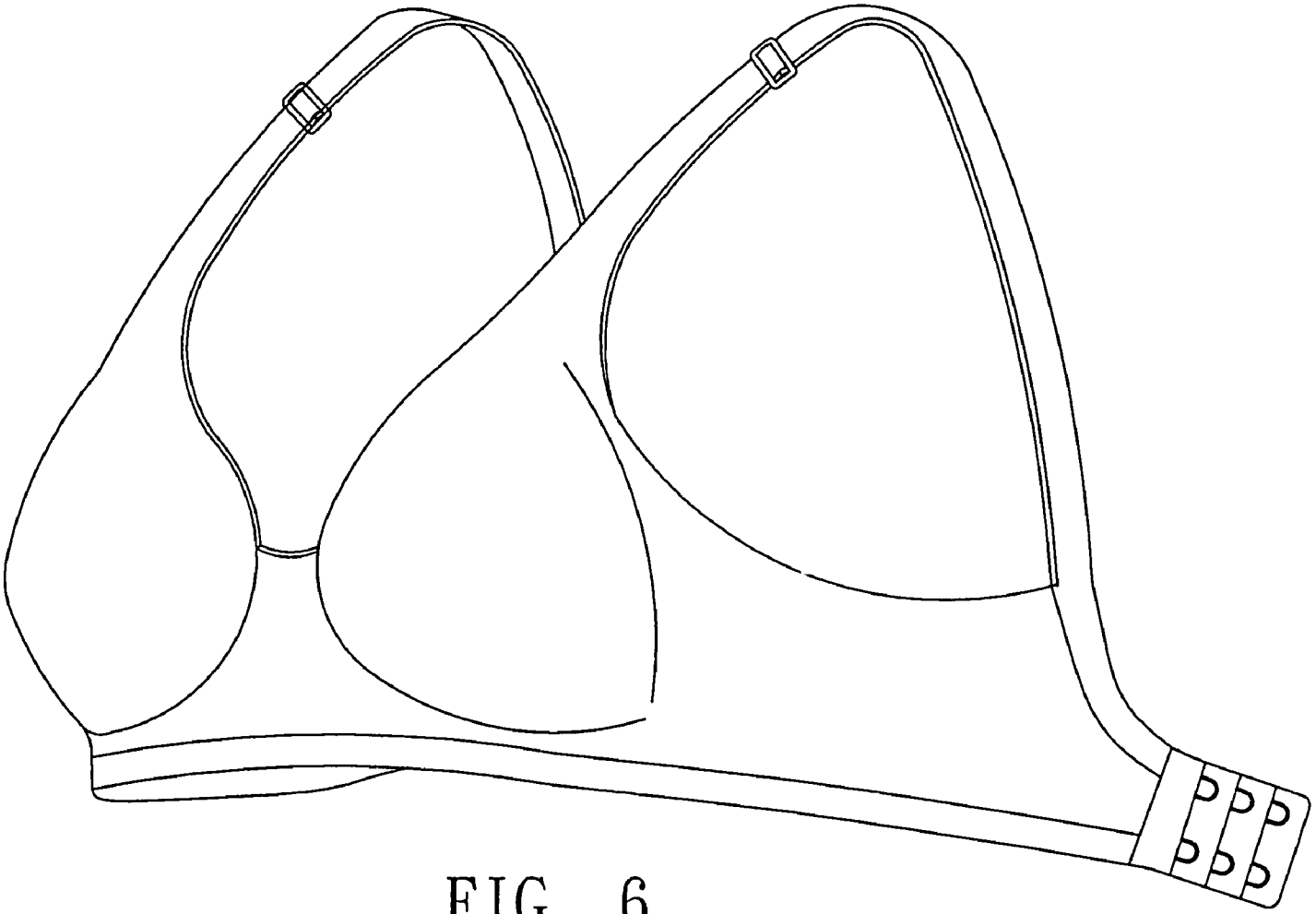
FIG. 6 PRIOR ART
FIG. 6 is a perspective view of a prior art brassiere.

Moreover, with reference to FIGS. 1 and 5, underneath one first adjustable strap (11) of either cup (10), there is disposed a lining-strip (12), and a lining-strip (32) disposed beneath each second adjustable side-strap (31). The width of above-mentioned lining-strips (12, 32) is at least equal to the width of the corresponding adjustable buckle fastener (20, 40). This is to avoid any discomfort on locations of the first adjustable buckle fastener and the second adjustable buckle fasteners caused by wearers' direct body contact.

In conclusion, the two cups of the brassiere can be fit to an individual's breasts totally by adjustment on the first and second adjustable buckle fasteners, and balance the holding power according to the chest measurement of each individual. It brings much more comfort to wearers, and not affects wearers' health care in the long run.

What is claimed is:

1. An overall adjustable brassiere having a pair of cups each with a side-strap extending therefrom, the adjustable brassiere comprising a first adjustable buckle fastener centrally disposed in an interval between the two cups of the brassiere, and a pair of second adjustable buckle fasteners respectively in the side-straps of the two cups, each of the first and second adjustable buckle fasteners has a rectangle contour, each of the first and second adjustable buckle fasteners having two slits and a serrated cut adjacent an inner one of the two slits at each of two opposing ends thereof, a first adjustable strap extending from each of two facing sides of the two cups, the first adjustable strap being passed through the slits of the first adjustable buckle fastener and through the serrated cut of a corresponding end thereof to fix the first adjustable strap, the side-straps of the two cups respectively comprising two sections, opposing end portions of the two sections respectively having a second adjustable strap extending therefrom, the second adjustable strap being passed through the slits of a respective second adjustable buckle fastener and through the serrated cut of a corresponding end thereof to fix the second adjustable strap; a lining-strip being disposed underneath one first adjustable strap of one of the two cups and respectively disposed under the second adjustable straps extending from the side-straps, each of the lining-strips having a width being at least equal to a width of a corresponding one of the first and second adjustable buckle fasteners.

2. An overall adjustable brassiere as claimed in claim 1, wherein the two slits in each of the two ends of the first and second adjustable buckle fasteners have a length and a width; the length corresponding to the width of the corresponding first and second adjustable buckle fasteners; and the width of the slits corresponding to a thickness of a respective one of the first adjustable strap and the second adjustable straps; the width of an outer one of the two slits being larger than the width of a corresponding inner slit.

* * * * *